United States Patent [19]

Castiglioni

[11] Patent Number: 4,953,845

[45] Date of Patent: Sep. 4, 1990

[54] DEVICE FOR HANDLING AND GUIDING BUNDLES WITH VERTICAL SHEET STACKERS

[75] Inventor: Antonio Castiglioni, Varallo Pombia, Italy

[73] Assignee: Civiemme S.r.l., Italy

[21] Appl. No.: 268,740

[22] Filed: Nov. 8, 1988

[30] Foreign Application Priority Data

Nov. 20, 1987 [IT] Italy ..... 22720 A/87

[51] Int. Cl.[5] ..... B65H 31/00

[52] U.S. Cl. ..... 271/217; 271/220; 414/790.2; 414/907

[58] Field of Search ..... 414/788.9, 789.9, 790, 414/790.1, 790.2, 790.7, 791.6, 792.6, 792.7, 794.6, 794.8, 907; 271/213, 214, 215, 216, 217, 220; 100/7, 100

[56] References Cited

U.S. PATENT DOCUMENTS

| | | | |
|---|---|---|---|
| 3,739,924 | 6/1973 | Stobb | 271/213 X |
| 4,311,090 | 1/1982 | Dudziak et al. | 271/215 X |
| 4,372,201 | 2/1983 | Dudziak et al. | 271/215 X |
| 4,498,381 | 2/1985 | Convey, Jr. | 414/790.2 X |
| 4,554,867 | 11/1985 | Thumm | 414/789.9 X |
| 4,577,853 | 3/1986 | Duke | 271/217 |
| 4,618,054 | 10/1986 | Muller | 414/790.2 X |
| 4,772,169 | 9/1988 | Masini | 414/790.2 |
| 4,880,350 | 11/1989 | Stobb | 414/790.2 |

*Primary Examiner*—Joseph J. Rolla
*Assistant Examiner*—Boris Milef
*Attorney, Agent, or Firm*—Kirschstein, Ottinger, Israel & Schiffmiller

[57] ABSTRACT

An arrangement for handling and guiding a bundle of sheets in and between stacking and binding stations in which the sheets are stacked and bound respectively. The arrangement includes an arm displaceable from a pressing position in which the arm engages an uppermost sheet in the bundle in the stacking station to form a pressed bundle, to a removed position in which the arm is disengaged from the uppermost sheet. The pressed bundle is moved through the stacking station and conveyed from the stacking station to the binding station while the arm is maintained in the pressing position to prevent sheet disarrangement during such passage. In the binding station, the arm is displaced to the removed position to form a released bundle which is compressed prior to binding in the binding station. A guard engages uppermost sheets in the bundle in the binding station during displacement of the arm to the removed position to prevent sheet disarrangement.

7 Claims, 4 Drawing Sheets

DEVICE FOR HANDLING AND GUIDING BUNDLES WITH VERTICAL SHEET STACKERS

BACKGROUND OF THE INVENTION

1. Field of the Invention

The present invention concerns a device for handling and guiding bundles with vertical sheet stackers.

2. Description of Related Art

With known vertical sheet stackers, the sheets arrive at the stacker from the rotary press in the form of a continuous overlapping stream, like scales, and are then gathered up by the stacker to form a bundle of a determined height, the sheets being superposed one on top of the other. It is a common feature of a known type of stacker that for the initial stage of bundle formation a so-called vane separator is used, retractable and capable of oscillating, which is designed to be positioned in the incoming stream of sheets; this vane then transfers the sheets starting to be formed into a bundle onto a fork support that can be shifted downwards, and the formation of the bundle is completed on this fork. As soon as the bundle is completed, the fork is rapidly lowered onto an L-shaped roller conveyor underneath, linking the bundling station with the associated binding station, from where the secured bundles are then conveyed to a palletizer.

It is well-known that with vertical stackers the rapid lowering of the finished bundle onto the roller conveyor underneath is a very delicate handling operation, as the sheets are loosely arranged on top of one another, and the degree of compactness in the bundle becomes increasingly less from the bottom of the pile upwards, since its compactness is determined solely by the weight of the superposed sheets. As a result, during this rapid descent stage the bundle expands, with the well-known concertina effect, especially in the top part. This expansion makes the bundle arch out towards the outside of the stacker. The extent of this expansion, or bending outwards, varies in accordance with a variety of factors, including the type of paper used for the sheets, the number of folds provided for in the sheets, and so on. Such expansion is, for example, fairly significant in the case of sheets that are folded into three, since they will then have one side that is thicker than the rest of the sheet. Moreover, a certain amount of air will remain trapped between individual pages with these sheets. These conditions therefore heighten the "suction" effect to which the bundle is subjected at the top in its rapid descent, which provokes undulation between individual sheets so that they are liable to slide about on top of one another. As a consequence, the arrangement of the sheets in the top part of the bundle begins to break up, leading to the arching outwards that has been mentioned. Disarrangements of this kind create various problems when it comes to subsequent handling of the bundles. In the first place there are problems regarding conveyance of the finished bundles from the stacking station to the adjoining binding station, since further disarrangements may occur in the course of such conveyance, and the sheets at the top may come away from the bundle altogether. There are other problems at the binding stage. The sheets, or wads of sheets, at the top of the bundle are out of true with one another, that is to say, they project beyond the ideal contour of the bundle, and the sheets that project in this way become damaged by the securing straps and their subsequent handling while being palletized. The Italian Patent application No. 20344 A/83, now Italian Patent No. 1,163,186, proposes equipping the vertical stacker with a trolley with oscillating sides in order to ensure that the sides of the bundle stay in the correct position during conveyance from the stacking to the binding station. Such trolleys, therefore, act only on the sides of the bundles, and are not capable of overcoming the difficulties referred to above.

Further, in U.S. Pat. No. 4,554,867 provision is made for mounting on the sides of a so-called trolley longitudinal cylinder/piston units on the free upper end of whose piston rods is attached a transverse cylinder/piston unit. After the bundle has been completed and lowered in a rapid descent onto the roller conveyor, and the sides of the trolley have been closed in a rotary movement against the bundle, the piston rods of the transverse cylinder/piston units are expelled so that they are positioned above the bundle. Next the piston rods of the longitudinal cyclinder/piston units are retracted, causing initial compression of the bundle before it is conveyed to the binding station. Clearly, this pressure on the bundle is effected after the disarrangements of the sheets referred to above will have taken place, so that neither is this action by the trolley capable of overcoming the difficulties already mentioned.

SUMMARY OF THE INVENTION

The object behind the present invention is the creation of a device for handling and guiding bundles with vertical sheet stackers that can overcome the difficulties referred to above and can provide a reliable means of preventing undesirable arching of the top part of the bundles in the course of their rapid descent, and disarrangement of the top part of the bundle during its conveyance from the stacking station to the binding station, and more precisely until the inception of compression proper in the course of the binding process.

It is within the range of the stated object to provide for a compact device, of simple design, that can be used, moreover, with existing stackers. In stackers already equipped with a trolley for guiding the bundle, the device to be proposed must also be capable of being mounted advantageously on the trolley.

The object behind the present invention is achieved by a device for handling and guiding bundles the special features of which are to be found in the claims.

.andling and guiding bundles according to the invention. Above all, with the bundles being prevented from becoming disarranged, the whole of the process of handling the sheets can now be automated, from their arrival at the stacker until their delivery to the palletizer, in secured bundles. Preventing the bundles from becoming disarranged prevents the occurrence of damage to the sheets, and rejects, and hence also problems for the downstream machinery dealing with the sheets, the pickup machines, for example. This further alleviates the supervisory task of the operator, whatever the type of sheets being handled. The proposed device also operates advantageously in such a way as not to interfere with the speed of stacking, even at the highest speeds. The proposed device is of compact design, and can accordingly be used without any problem with existing stackers. If these are equipped with a trolley for conveying the bundles, the proposed device can be advantageously mounted on the said trolley. Another advantage of the device according to the invention is to be seen in the fact that it is capable of handling bundles made up from any types of sheet, or sheets made of any kind of paper, without any prior adjustments being required.

Further characteristics, advantages and details of the handling and guiding device according to the invention will become clear from the description that follows, with reference to the attached drawings, illustrating by way of example a preferred embodiment of the proposed device, which is shown as one possible example, and is not limitative.

DETAILED DESCRIPTION OF THE PREFERRED EMBODIMENT

Figure 1:
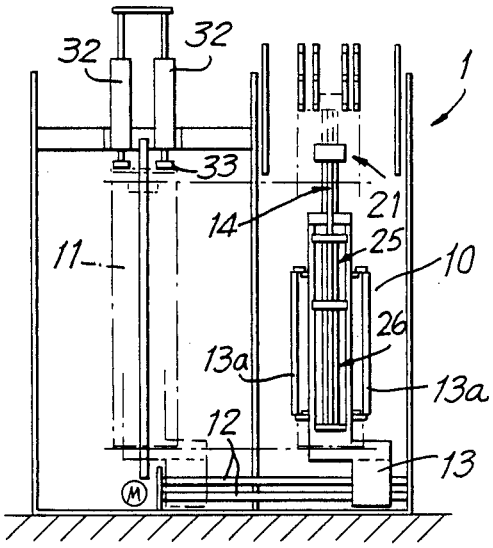
FIG. 1 is a frontal diagrammatic view of a vertical stacker equipped with the device for handling and guiding bundles according to the invention, with adjoining binding station for the bundles.

In these above-mentioned figures, for which differing scales have been used for greater clarity, and in which identical parts are denoted by the same reference numerals, 1 denotes a vertical stacker of the type that is known, as can be found, for example, in the application for Italian Patent No. 20344 A/83 now Italian Patent No. 1,163,186, filed by the Applicant. This exhibits a feed channel 2 for the sheets 3 as well as a vane separator 4 for starting the formation of the bundle and a fork 5 for completing the bundle and for lowering it in rapid descent onto the roller conveyor 6, comprising a number of rollers forming a backpiece part 7 and a bed part 8. The completed bundle is denoted by 9. This is made up at the stacking station, denoted by 10, whilst 11 denotes the adjoining station where the bundle is secured, which is per se known. In the version illustrated, 12 denotes guide bars on which a mobile trolley 13 is provided for conveyance of the bundle, as specified in the application for Italian Patent No. 20345 A/83 now Italian Patent No. 1,163,187 filed by the Applicant. For the sake of simplicity, in the version shown the trolley 13 is used that is already envisaged as support for the handling and guiding device according to the invention, depicted as an ensemble at 14. Again for reasons of simplicity, the mechanism for transporting the trolley 13 is not illustrated, since this, together with the oscillating side arms 13*a*, can be selected at discretion.

The device 14 according to the invention comprises a reciprocating action positioning arm 15, at right angles to the roller backpiece 7, or to the bundle 9, such action being imparted by a rotary cylinder/piston unit 16, known per se, to whose output shaft 17 there is splined a circular serrated sector 18. The sector 18 is engaged with a rack 19 fixed by means of screws (in a method not illustrated in detail) to the positioning arm 15. The numeral 20 denotes the ensemble of a slide guide element to which the arm 15 is attached to ensure that the same moves in the correct reciprocating linear motion.

Figures 5, 6, 7, 8, 9:
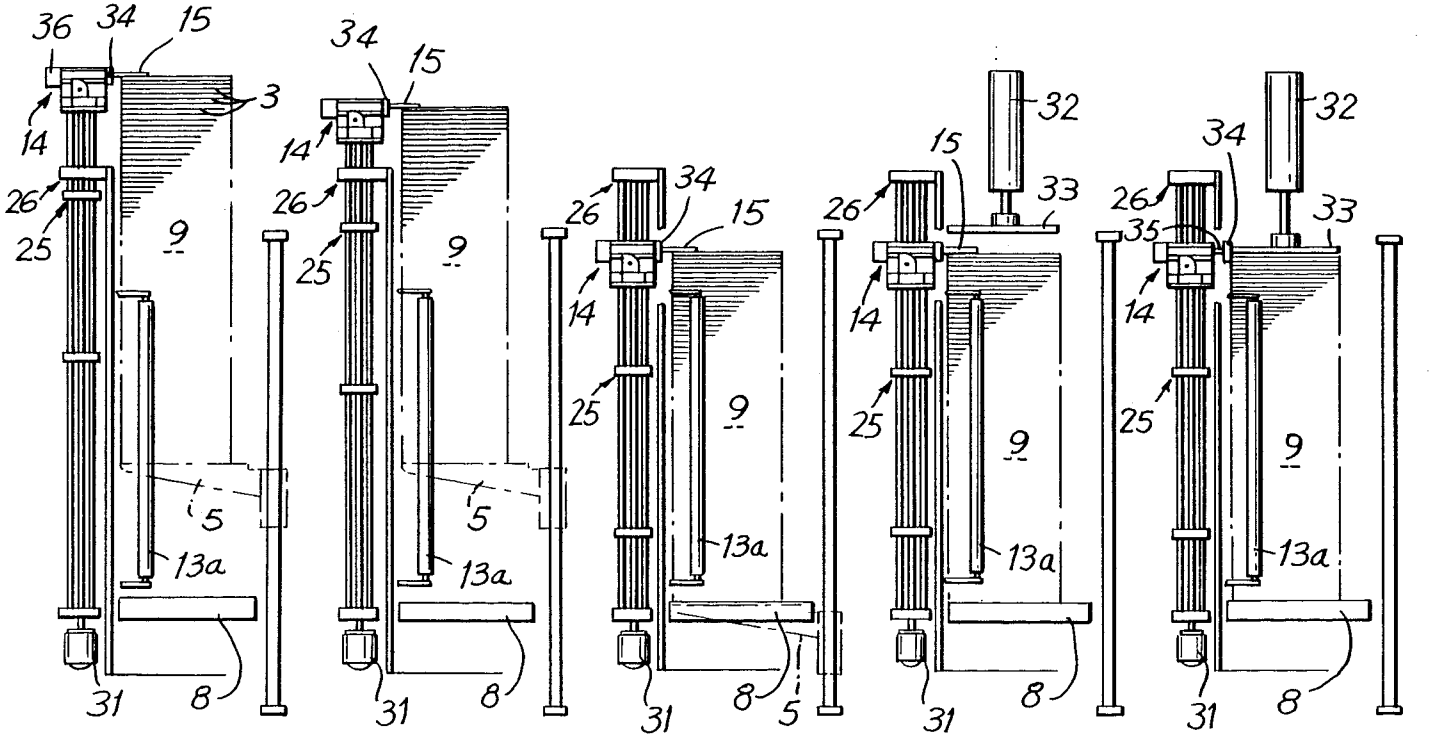
FIG. 5–9 are diagrammatic side views illustrating the different stages of bundle-handling according to the invention.

The arm 15 and the rotary cylinder/piston unit 16 and the other above-mentioned components form a structural assembly 21 mounted on a support plate 21*a*. The latter is attached to the end of a piston rod 22 of a cylinder/piston unit 23, whose cylinder 24 is affixed to a movable frame 25, referred to below, on a framework 26 affixed to the trolley 13. The numeral 25*a* denotes guide rods parallel with the piston rod 22. The frame 25 is guided on the framework 26 by means of tubular guides 25*b* sliding over two guide rods of said framework 26, and can be moved forwards and backwards within it with the aid of a threaded rod 28, supported in the framework 26 in such a way that it can revolve but cannot be axially shifted, and a nut screw 29 supported in a fixed position on the bottom crosspiece 30 of the framework 26, or on the trolley 13. The way the device according to the invention described here operates is now set out with reference to the different operational stages illustrated in FIGS. 5–9. After the formation of the bundle 9 has been completed on the fork 5, the positioning arm 15 is brought out (FIG. 5) and immediately before the fork begins its rapid descent the bundle is precompressed, in accordance with the invention, the arm 15 being caused to execute a rapid descent by the action of the cylinder/piston unit 23 (travel h in FIG. 3), so as to ensure that the well-known expansion of the bundle does not occur and to cause it, preferably, to be lightly precompressed (FIG. 6).

The bundle, lightly precompressed in this fashion, can now be lowered in rapid motion onto the fork 5 without any problem. At the inception of this motion of the rapid lowering of the bundle 9, the motor 31 starts to rotate the threaded rod 28 and at the same time causes the frame 25 to be lowered, or the arm 15, and, to be precise, in synchronization with the speed of the rapid descent of the bundle, or the fork 5.

When the bundle 9 reaches the roller bed 8 of the roller conveyor 6 (FIG. 7), the fork 5, or the bundle 9, halts its descent, and at the same time the downwards movement of the frame 25 also comes to a halt. There now takes place the stage of conveyance of the bundle 9 from the stacking station 10 to the binding station 11 through movement of the trolley 13, by a method that is per se known. It is to be noted that while the bundle is being conveyed in this way the positioning arm 15 keeps the bundle 9 slightly precompressed, or correctly positioned. When the bundle 9 arrives at the binding station 11, the compression pistons 32 then descend, in the known way; they are equipped with an end board 33 supported by the same by means of suckers, for example, not further illustrated. The pistons 32 terminate their stroke shortly before coming into contact with the positioning arm 15 (FIG. 8). Next the arm 15 is retracted, via the unit 16, and the compression pistons 32 carry out the compression proper of the bundle 9, which is followed by traditional strapbinding.

Figure 2:
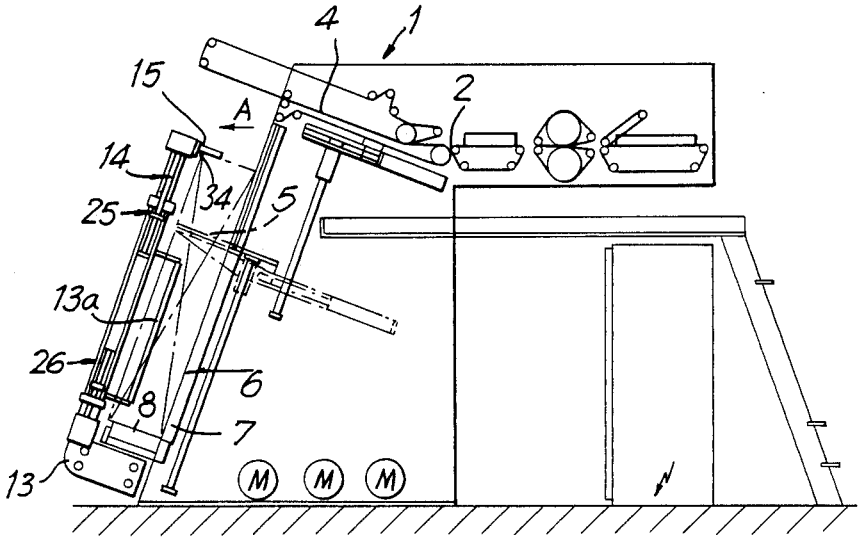
FIG. 2 is a side elevation view of the stacker in FIG. 1.
Figure 3:
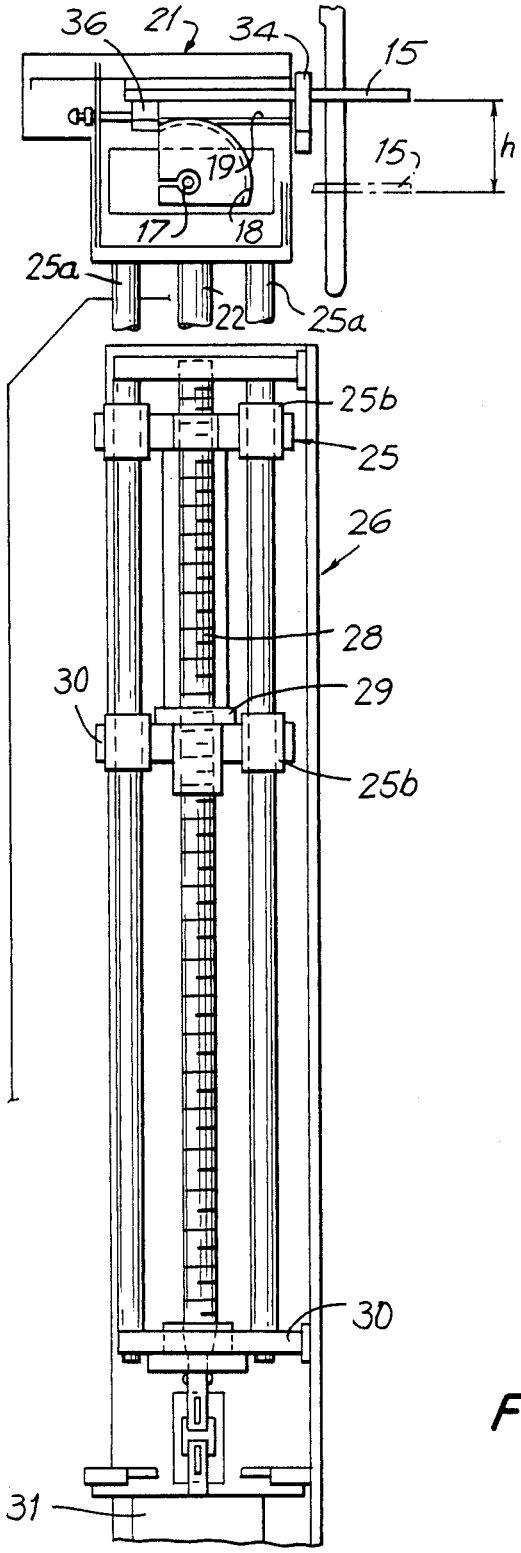
FIG. 3 is a larger scale side elevation illustrating the device for handling and guiding bundles according to the invention.
Figure 4:
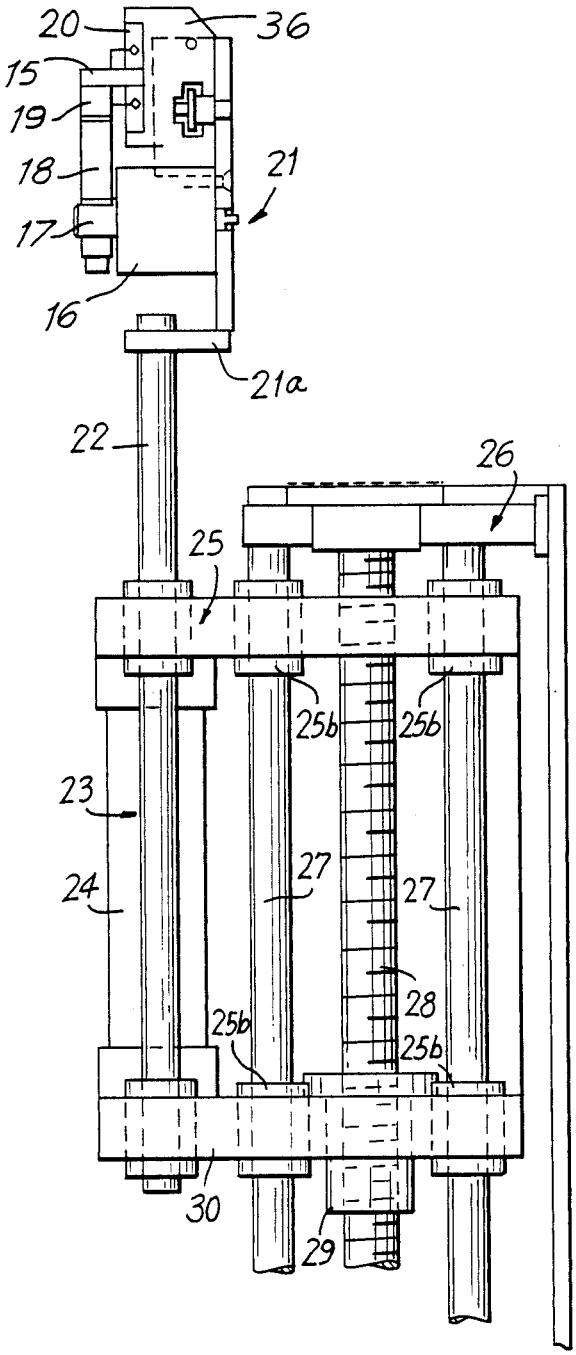
FIG. 4 is a frontal view of upper part of the device according to the invention, seen in the direction of arrow A in FIG. 2.

Since at this operating stage, the retraction of the arm 15, some of the sheets at the top could still become displaced, as they tend to follow the arm 15 as it moves, according to the invention the use of a positioning catch protection is provided for, as shown in FIGS. 2 and 3. In practice this projection takes the form of a small plate 34 attached to the free end of the piston rod 35 of a cylinder/piston unit 36, likewise supported in the structural assembly 21 already mentioned. Before the arm 15 is retracted from the bundle, the unit 36 is actuated, causing the piston rod 35 to be ejected and the catch protection 34 to be positioned in front of the bundle 9

(FIG. 9). In this way the sheets at the top are reliably prevented from following the arm 15 in its retraction movement. After the pistons 32 have commenced their compression operation, the catch projection is retracted once more. The trolley 13 thereupon executes its return run and the device 14 therefore returns to the stacker 10. In the meantime the motor 31 has rotated, in the reverse direction, the threaded rod 28 and the frame 25 returns to its up position. The cylinder/piston unit 23 will meanwhile have caused the structural assembly 21 to rise, so that the positioning arm 15 is now ready to be brought out again on the next completed bundle 9. From the description of the construction and function of the device according to the invention it can be seen that it provides an effective solution in terms of the underlying object of the latter, and enables the advantages mentioned in the introductory section to be put into practice.

In practice, all the separate parts, or the separate components, can be replaced by others that are equivalent from a technical and/or functional point of view, but this is no ground for discarding the range of protection in respect of the present invention. For example the cylinder/piston units that are described could be replaced by units comprising a rack and motor-driven pinion, or different configurations could be selected for the support frame for the positioning arm, as also of the framework housing the frame, and so on, without any abandonment of the range of protection of the invention. It is likewise within the range of the present invention to provide for a vertical positioning arm in the shape of a beak, hinged onto the said frame so that it can oscillate and move forwards and backwards towards and away from the bundle 9.

All the characteristics to be found in the description, claims and drawings are considered to be essential for the present invention, both singly and in any combination of them.

I claim:

1. An arrangement for handling and guiding a bundle of sheets in and between stacking and binding stations in which the sheets are stacked and bound, respectively, comprising:

(a) means for pressing the sheets in the bundle in the stacking station to form a pressed bundle, said pressing means including an arm mounted for displacement between a pressing position in which the arm engages an uppermost sheet in the bundle, and a removed position in which the arm is disengaged from the uppermost sheet;

(b) means for moving the pressed bundle along a stacking path through the stacking station with the arm in the pressing position;

(c) said pressing means includes means for moving the arm in a direction generally parallel to the stacking path;

(d) said pressing means being mounted on a support that, in turn, is guidably mounted for movement in a direction generally parallel to the stacking path;

(e) means for conveying the pressed bundle from the stacking station along a transfer path to the binding station with the arm in the pressing position;

(f) means for displacing the arm to the removed position to form a released bundle in the binding station; and (g) means for compressing the released bundle with the arm in the removed position prior to binding in the binding station.

2. The arrangement according to claim 1, wherein the arm is mounted for joint movement with the moving means along the stacking patch, and also for joint movement with the conveying means along the transfer path.

3. The arrangement according to claim 1, wherein the conveying means includes a trolley, and wherein the pressing means is mounted on the trolley.

4. The arrangement according to claim 2, wherein the displacing means displaces the arm from the pressing position to the removed position along a displacement path which is generally perpendicular to the stacking path.

5. The arrangement according to claim 4; and further comprising a guard mounted for movement between a guarding position in which the guard engages uppermost sheets in the bundle in the binding station during displacement of the arm to the removed position, and a retracted position in which the guard is removed from the bundle.

6. The arrangement according to claim 5, wherein the guard is a plate mounted for reciprocating movement between the guarding and retracted positions.

7. The arrangement according to claim 2, wherein the pressing means includes an assembly having a rotary cylinder/piston unit that has an output shaft, a sector gear mounted on the shaft for angular movement, and a slide rack meshingly engaging the sector gear, said slide rack being connected to the arm, said unit being operative for slidably displacing the arm between the pressing and removed positions in a direction which is generally perpendicular to the stacking path.

* * * * *